United States Patent [19]

Hoffman

[11] Patent Number: 4,673,211

[45] Date of Patent: Jun. 16, 1987

[54] LIGHTWEIGHT COMPACT CHAIR WITH BACK SUPPORT, FOR OUTDOORS USE

[76] Inventor: Timothy C. Hoffman, 104 44th St., Manhattan Beach, Calif. 90266

[21] Appl. No.: 836,700

[22] Filed: Mar. 6, 1986

[51] Int. Cl.[4] ..... A47C 4/00

[52] U.S. Cl. ..... 297/16; 297/457; 5/129

[58] Field of Search ..... 297/16, 17, 441, DIG. 6, 297/457; 5/127, 129, 57 B

[56] References Cited

U.S. PATENT DOCUMENTS

| | | | |
|---|---|---|---|
| 950,070 | 2/1910 | Funke | 5/129 |
| 2,692,153 | 10/1954 | Schlueter | 5/57 B |
| 2,712,349 | 7/1955 | Le Voir | 297/457 |
| 2,888,689 | 6/1959 | Mourot | 5/129 |
| 3,446,531 | 5/1969 | Froelich | 297/DIG. 6 |
| 4,047,752 | 9/1977 | Rohr | 297/16 |

FOREIGN PATENT DOCUMENTS

| | | | |
|---|---|---|---|
| 1288461 | 9/1972 | United Kingdom | 297/441 |

*Primary Examiner*—Francis K. Zugel
*Attorney, Agent, or Firm*—Monty Koslover

[57] ABSTRACT

A lightweight compact chair with back support is described, comprising a triangular sling, a frame supporting the sling, and a backrest. The frame is comprised of three support members, preferably of tubular aluminum, and a hinged device to which each of the three support members is attached. When unfolded for sitting, the two front support members lay on the ground at opposing angles to one another, their ends turned upward and acting as legs supporting the sling. The rear support slopes upward from the ground and is extended by a T-shaped member, which provides one of the three supporting points for the sling, as well as providing support for an attached backrest. The three support members are pivotably connected by the hinged device which allows them to be either locked in place, or folded together in substantial parallel alignment to make a compact carrying package.

5 Claims, 20 Drawing Figures

7
8
12
13
14
15
8 A
8A
9
16
17
18
11
10
20
21
21A
22
19
19A

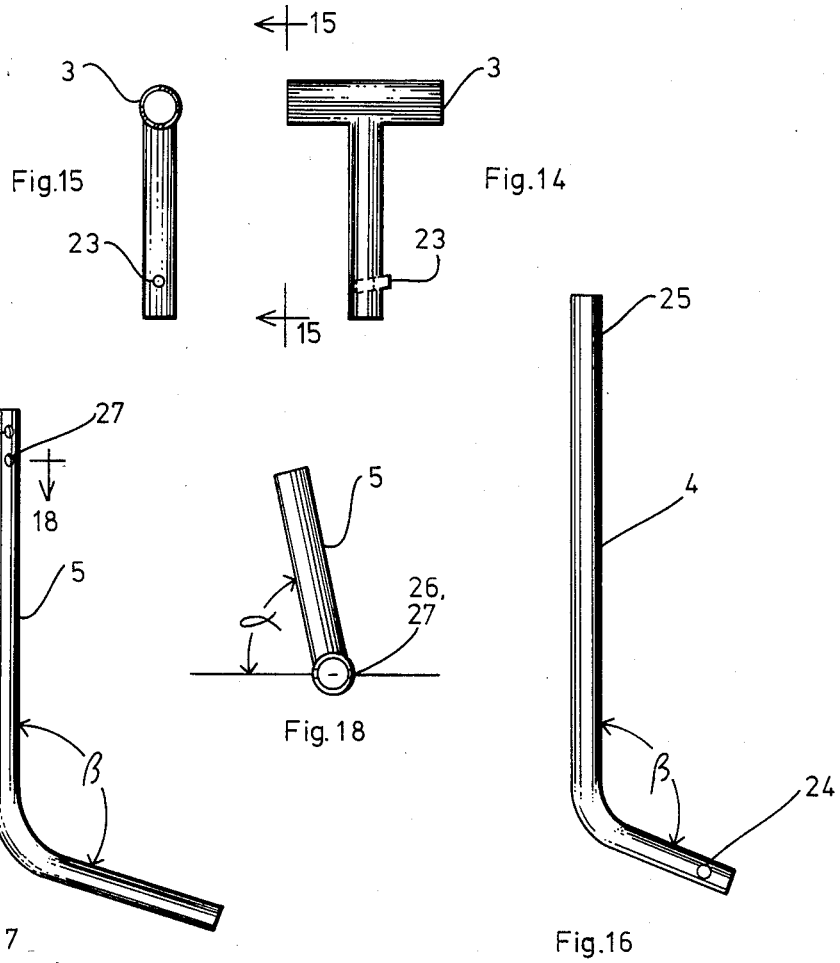
Fig.18
Fig.17
Fig.16
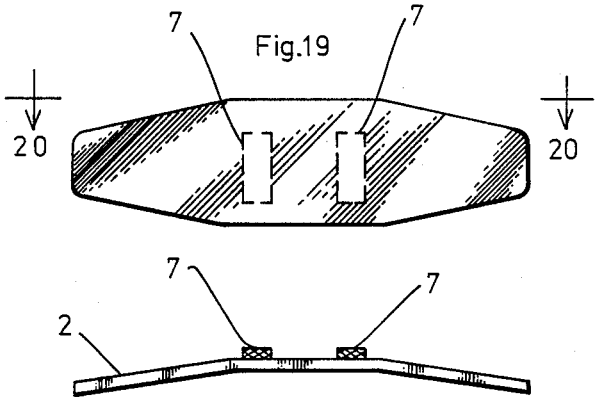
Fig.19
Fig.20

LIGHTWEIGHT COMPACT CHAIR WITH BACK SUPPORT, FOR OUTDOORS USE

BACKGROUND OF THE INVENTION

1. Field of the Invention

This invention relates to chairs for outdoor use, and more particularly to a lightweight, compact chair, with back support, capable of being easily folded and carried.

2. Description of the Prior Art

Many designs exist today for compact chairs, where the chair support members may be disassembled, or collapse into close parallel alignment to facilitate packing. These chairs typically, are comprised of many support members and are joined together in a complex arrangement. As a result, the chairs are generally bulky and too heavy for inclusion in a back-packing kit, or other outdoor activity where weight and size are a prime consideration. Examples of these devices can be found in U.S. Pat. Nos. 4,148,520 (Miller) and 4,258,951 (Groom). In the first mentioned device, the support members are four poles, held in position by tension cables. The device takes some skill to erect or disassemble. In the latter device, the number of support members is large and the arrangement complex. These, and similar chairs require various detailed procedures to be followed to fold and unfold the chair, and as a result are inconvenient. Other chairs, which may be light, lack the disadvantages mentioned above, but do not provide back support and are not comfortable. Thus, there exists a need for a comfortable lightweight chair that is simple to erect or disassemble, and presents little additional weight or bulk for a back-packer or camper to carry.

SUMMARY OF THE INVENTION

The invention comprises a triangular sling, fastened to the ends of three support members which are held together by a bracket support mechanism, forming an inverted wye. A removable backrest, held in place by adhesive tabs, is placed against a T-section located at the top of the rear support member. Side-to-side stability is enhanced by the addition of protruding tabs to the bracket mechanism shape. The bracket support mechanism allows the two front support members to be folded back, parallel with the rear support member, forming a compact carrying package. Alternatively, the parts may be simply disassembled. No tools of any kind are required for folding or disassembly.

In the preferred embodiment, the support members are made of light weight metal tubing. Both the backrest and the bracket support mechanism, are similarly made of light weight metal and designed for the minimum weight compatible with desired strength and reliability.

Accordingly, it is a principal object of this invention to provide a chair with back support, that can be easily folded or disassembled into a compact configuration.

Another object is to provide a comfortable chair that is light in weight, and presents a minor burden for backpackers or similar users.

It is another object to provide a chair using only three support members, therefore having fewer points of failure than chairs having a more complex mechanism. It is yet another object to provide a chair with a back support, that is simple to manufacture and maintain.

Further objects and advantages of the invention will become apparent from the study of the following portion of the specification, the claims and the attached drawings.

BRIEF DESCRIPTION OF THE DRAWINGS

In describing the preferred embodiment of the invention illustrated in the drawings, specific terminology will be resorted to for the sake of clarity. However, it is not intended to be limited to the specific terms so selected, and it is to be understood that each specific term includes all technical equivalents which operate in a similar manner to accomplish a similar purpose.

FIG. 14 is a plan view of the T-section member which mates with the rear support member;

FIG. 15 is a side elevation view of the T-section member taken along line 15—15 of FIG. 14;

FIG. 16 is a plan view of the rear support member;

FIG. 17 is a plan view of the right front support member which is identical to the left front support member except for the angle at which the holes are drilled;

FIG. 18 is a cross-section view of the right front support member taken along line 18—18 of FIG. 17, showing the angle $\alpha$ made by the drilled holes with the bend plane; for the left front support member, the angle $\alpha$ is the mirror image of that shown for the right front support member in FIG. 18;

FIG. 19 is a plan view of the backrest, showing the approximate location of adhesive pads; and FIG. 20 is a side elevation view of the backrest.

DESCRIPTION OF THE PREFERRED EMBODIMENTS

Figure 1:
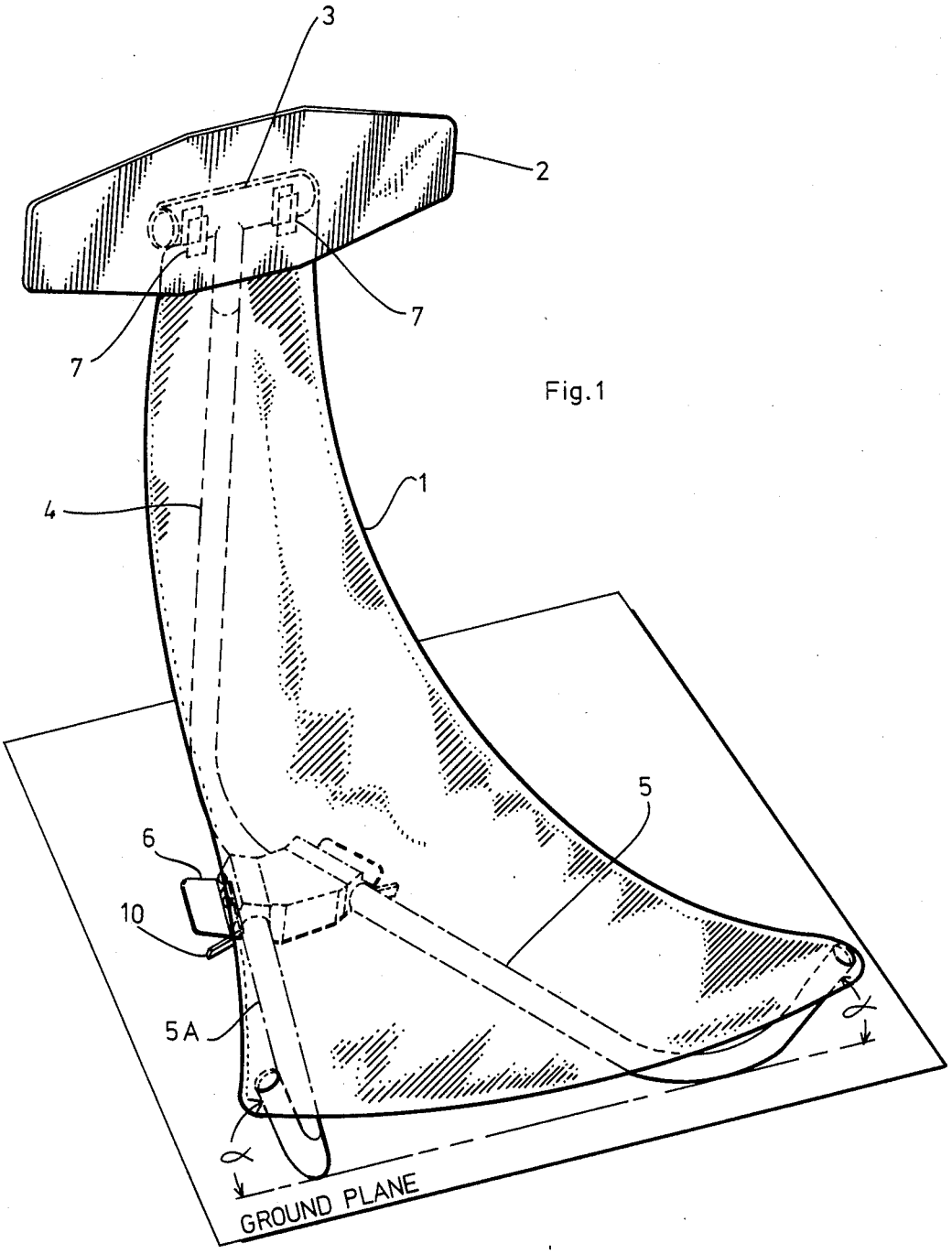
FIG. 1 is a perspective view of the device illustrating the chair set up for use.

Referring particularly to the drawings, there is shown in FIG. 1 a preferred embodiment of the lightweight compact chair device. The device includes a sling 1, a backrest 2, a T-section member 3, a rear support member 4, a right front support member 5, a left front support member 5A, a bracket support mechanism 6 and two sets of removable adhesive pads 7 located on sling 1 and backrest 2.

As shown in FIG. 1, the right and left front support members 5 and 5A, are secured to the bracket support mechanism 6 so that the plane formed by the vertical portion of the front support members, is at an angle $\alpha$ with the ground plane on which the chair is resting. The angle $\alpha$ for this embodiment is approximately 75 degrees, and is selected for reasons of frame stability, and also to enable adequate clearance with the rear support member 4 when the frame is folded. In the interests also of promoting frame stability and countering any tendency to tip sideways, substantial tabs are provided on either side of bracket support mechanism 6. The sling 1, may be of any suitable material such as canvas, providing only that it be strong enough to support an adult human weight. In this embodiment, the sling 1 is shown with pockets formed in its front corners so as to fit over the ends of the right and left front support members 5 and 5A respectively, providing support for sling 1. At the top or rear end of sling 1, a pocket is sewn or otherwise fastened, allowing T-section member 3 to be inserted in the pocket, thereby providing support for the sling 1. It is not essential that pockets be formed in the sling 1 material for fastening to the support members. Any suitable fastening, capable of securing the sling 1 to the support members may be used.

Referring again to FIG. 1, the backrest 2 has located on its back surface, two strips of removable adhesive pads 7 such as "VELCRO". On the top front of sling 1, located at the 'T' of the T-section member 3, are two strips of removable adhesive pads 7. If made of "VELCRO", these strips 7 would be the mating strips with those on backrest 2. When the chair is fully assembled, backrest 2 is held in position on the sling 1 by pressing the removable adhesive pads 7 together.

When folding the chair for packing, it is desirable to remove the backrest 2. This is done by simply pulling it off the sling 1. It is not necessary to remove the sling 1 from the frame in order to fold the chair. The chair is folded by pulling on the release tabs of the bracket release assembly 10 located on either side of bracket support mechanism 6, allowing the front support members to pivot back. This position is shown and discussed later in FIG. 5.

Figure 2:
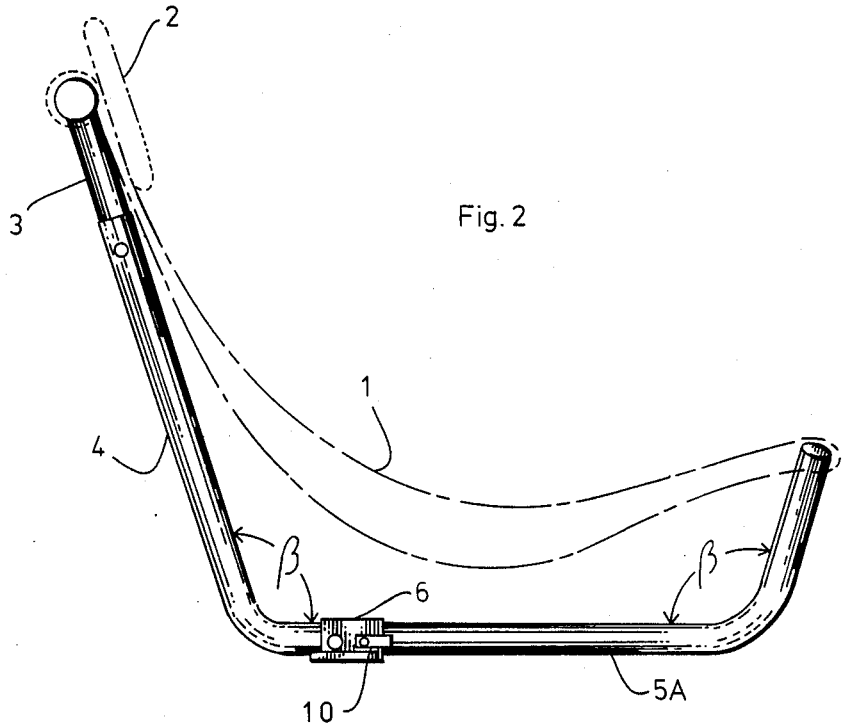
FIG. 2 is a side elevation view of the assembled frame, showing also the location of the sling and backrest.
Figure 3:
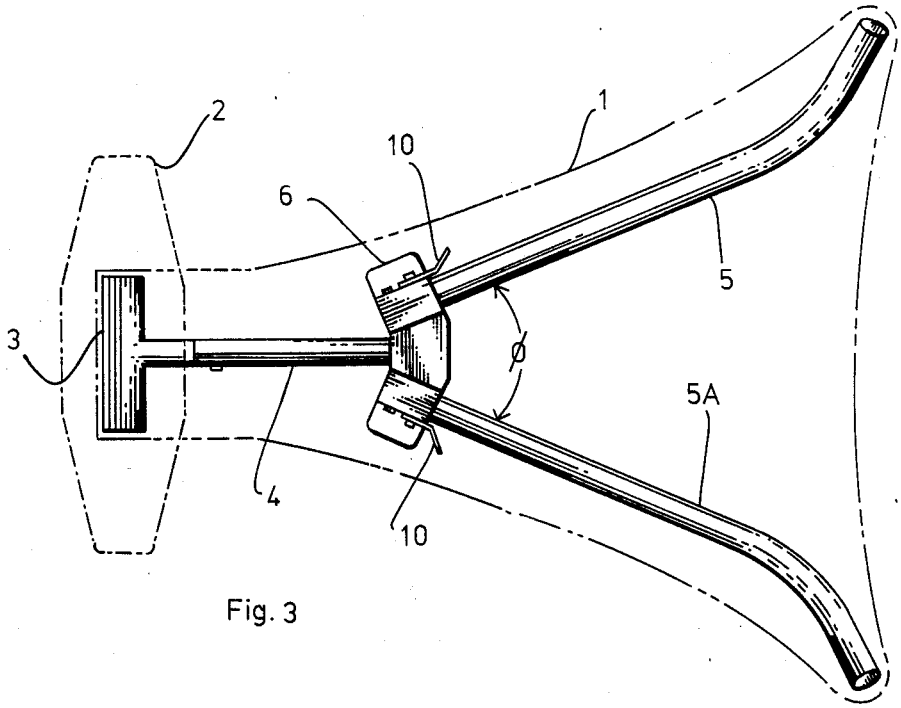
FIG. 3 is a plan view of the assembled frame.

Referring now to FIG. 2, there is shown a side elevation view of the assembled frame. FIG. 3 shows a plan view of the assembled frame. T-section member 3 is pushed into the end of the rear support member 4 tubing and snapped into place. The rear support member 4, the right front support member 5 and the left front support member 5A, are each inserted in their respective sections of the bracket support mechanism during factory assembly, but may be completely disassembled if necessary. When assembled, the rear support member 4 forms an angle $\beta$ with the ground plane of approximately 105 degrees. This angle, between the ground plane and the backrest, must be approximately 105 degrees to keep the torso against the backrest and yet not force the occupant to lean his or her head forward in order to balance properly. Referring again to FIG. 3, bracket support mechanism 6 is designed so that when assembled into it, the right front support member 5 and the left front support member 5A, form an included angle $\phi$ of approximately 55 degrees. This angle, taken together with a sufficiently straight length of the right and left front support members 5 and 5A, ensure a firm base for the seat.

Figure 4:
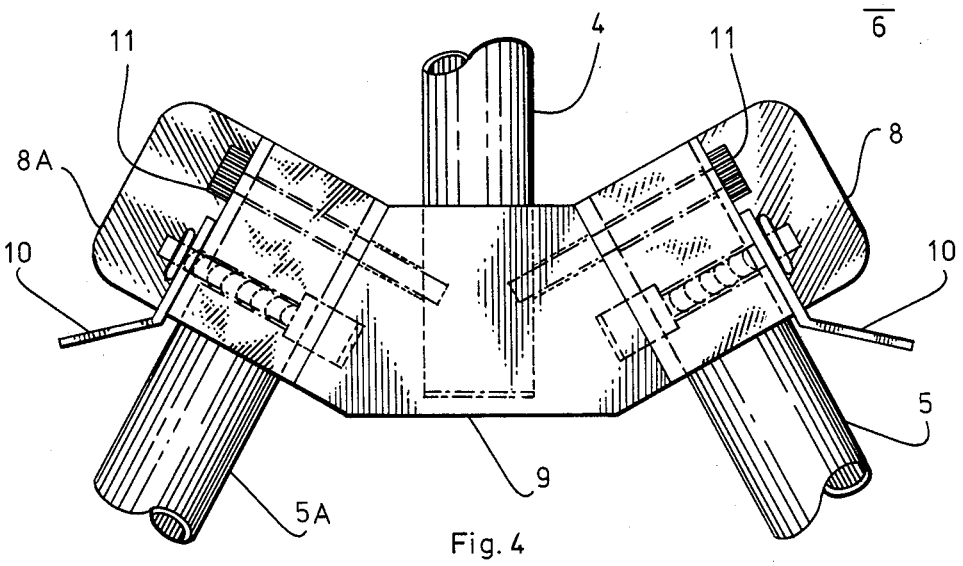
FIG. 4 is a partial plan view of a portion of the assembled frame showing detail of the bracket support mechanism.
Figure 5:
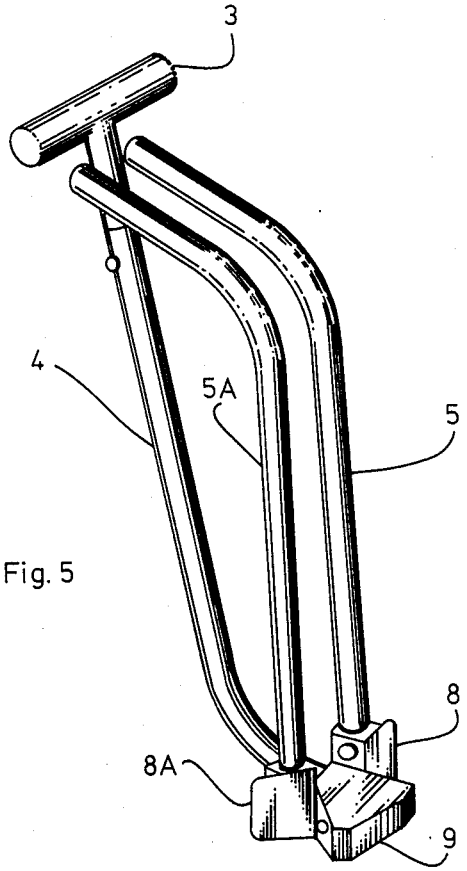
FIG. 5 is a view of the assembled frame, showing the two front support members folded back, ready for storage.

Referring to FIG. 4, detail of the bracket support mechanism 6 is depicted, with portions of rear support member 4, right front support member 5 and left front support member 5A connected to it. The bracket support mechanism is comprised of three major components. These are right bracket support 8, left bracket support 8A and center bracket support 9, all of which may be made of any suitable light weight material, such as aluminum or molded plastic. Left bracket support 8A is a mirror image of right bracket support 8. Both the left bracket support 8A, and right bracket support 8, are each held to center bracket support 9 by a fastening screw 11. Each fastening screw 11, protrudes through a tapped hole in center bracket support 9, to engage and retain rear support member 4. Holes are cut in rear support member 4 to receive each fastening screw 11. Two bracket release assemblies 10 are provided, one each for right bracket support 8 and left bracket support 8A. Each bracket release assembly 10 is spring loaded, so that a pin fits in a socket formed in center bracket support 9, together with fastening screw 11 preventing rotation of either front support member with respect to the center bracket support 9. The frame is thus held rigid. When it is desired to fold the frame, the release tabs of bracket release assembly 10 are either pulled or depressed, withdrawing the pins from their sockets in center bracket support 9, and allowing the front support members to pivot on fastening screw 11. This condition is shown in FIG. 5.

Figures 6, 7, 8, 9, 10, 11, 12, 13:
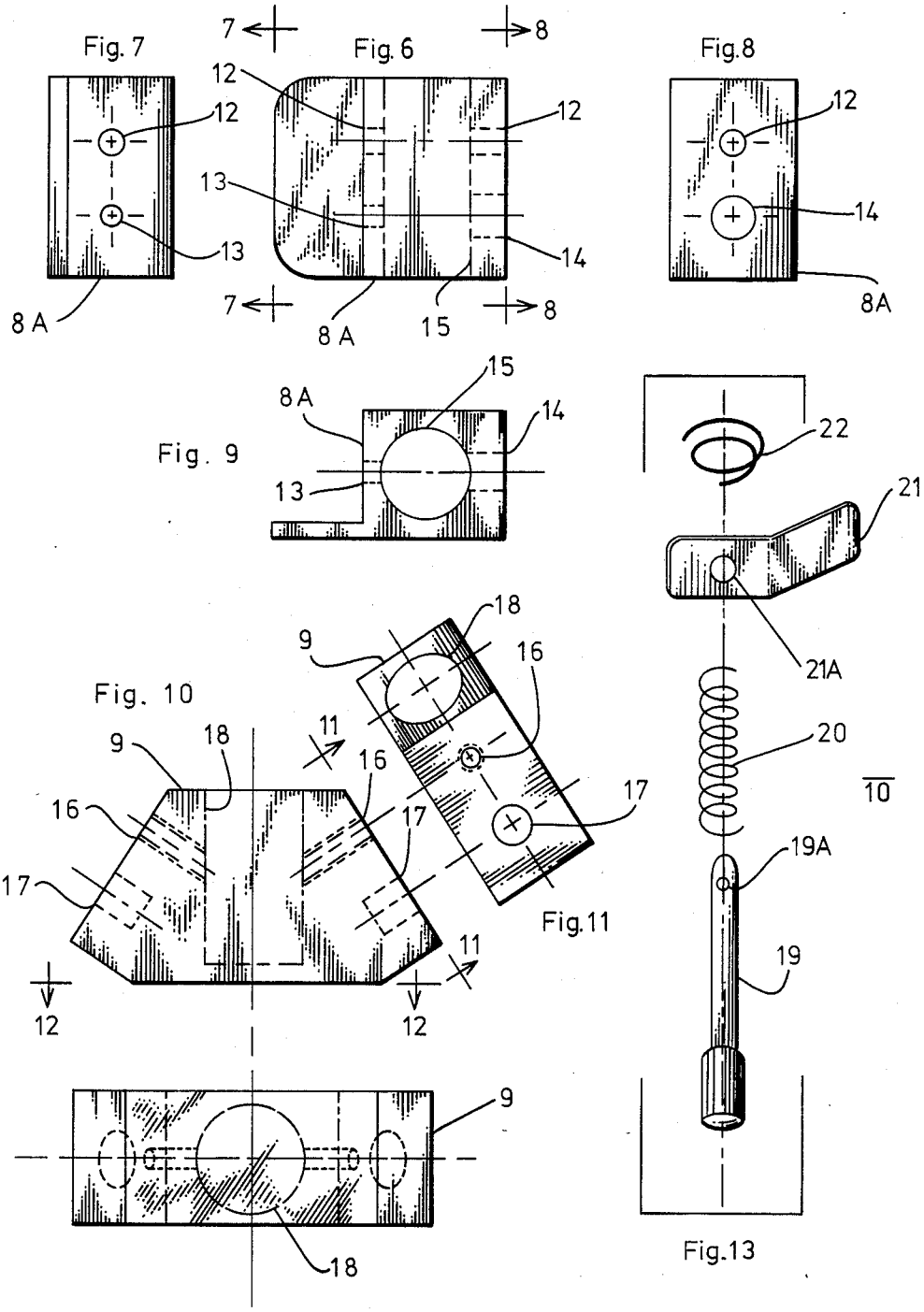
FIG. 6 is a plan view of the left bracket support, the right bracket support being a mirror image.
FIG. 7 is a side elevation view of the left bracket support taken along line 7—7 of FIG. 6.
FIG. 8 is a side elevation view of the left bracket support taken along line 8—8 of FIG. 6.
FIG. 9 is a front elevation view of the left bracket support.
FIG. 10 is a plan view of the center bracket support.
FIG. 11 is a side elevation view of the center bracket support taken along line 11—11 of FIG. 10.
FIG. 12 is a front elevation view of the center bracket support taken along line 12—12 of FIG. 10.
FIG. 13 is an exploded view of the bracket release assembly, two of the bracket release assemblies being used for the bracket support mechanism.

Referring specifically to FIGS. 6, 7, 8 and 9, there are shown a plan view of the left bracket support 8A, two side elevation views of left bracket support 8A taken along lines 7—7 and 8—8 of FIG. 6, and a front elevation view of the left bracket support 8A.

These views of left bracket support 8A, show its shape and the various holes drilled in it. Except for the mirror image location of holes 12 and 14, it is identical to right bracket support 8. Referring to FIG. 6, there is located a 1st hole 12 for fastening screw 11, passing transversely through the block section of the left bracket support 8A. A 2nd hole 13 and 3rd hole 14, are also located, passing transversely through the block. 3rd hole 14 is larger in diameter than 2nd hole 13, in order to accommodate the head of pin 19 of the bracket release assembly 10. A 4th hole 15, is located axially in the block section, to accommodate the tube of the left front support member 5A. In the right bracket support 8, 4th hole 15 will accommodate the tube of right front support member 5.

Referring now to FIGS. 10, 11 and 12, there are shown a plan view of the center bracket support 9, a side elevation view of center bracket support 9 taken along line 11—11 of FIG. 10, and a front elevation view of center bracket support 9 taken along line 12—12. A 5th hole 16 is located on two opposite sides of the center bracket support 9, and is tapped to receive the threaded portion of fastening screw 11. As shown in FIGS. 10 and 11, a 6th hole 17 is also located on the two opposite sides of center bracket support 9, and is formed to provide a socket for pin 19 of bracket release assembly 10. A 7th hole 18 is bored through the central axis of center bracket support 9, for the purpose of accommodating the tube of rear support member 4.

FIG. 13 is an exploded view of a bracket release assembly 10. Two such assemblies are utilized in the bracket support mechanism 6. The bracket release assembly 10 comprises a pin 19 having a large and small diameter section and pin retainer hole 19A drilled in one end of pin 19, a spring 20, a release tab 21 having a pin hole 21A located on it, and pin retainer 22. The inside diameter of spring 20 is sized to fit closely over the small diameter of pin 19. Pin retainer 22 is made of a stiff wire and the wire diameter is sized to fit easily through pin retainer hole 19A in pin 19. Pin 19 and release tab 21 may be made of aluminum, steel or a suitable molded plastic. When assembled, spring 20 is slightly compressed, exerting pressure against the stepped shoulder forming the head of pin 19, and against release tab 21. Release tab 21 is shaped and sized to act as a lever against the surface of the right and left bracket supports 8 and 8A when assembled in place, so that applied finger pressure on the release tab will cause withdrawal of pin 19 head from its socket in center bracket support 9, allowing rotation of either right or left bracket support 8 and 8A with respect to center bracket support 9.

FIG. 14 is a plan view of T-section member 3 and FIG. 15 is a side elevation view of T-section member 3 taken along line 15—15 of FIG. 14. The T-section member 3 is made of a light weight metal tubing such as aluminum. The bar forming the 'T' is welded on to the lower section. A spring-loaded pin 23 is located in the lower part of T-section member 3. This pin 23 is for the purpose of fastening T-section member 3 to rear support member 4 through a hole located in rear support member 4. The outside diameter of the long portion of T-section 3 is made slightly smaller than the inside diameter of the rear support member 4 tubing, so as to be easily inserted in it or removed therefrom.

The rear support member 4 is shown in plan view in FIG. 16. An 8th hole 24 and a 9th hole 25 are located drilled transversely at each end of the tubing. The 8th hole 24 is included for the purpose of receiving the end of fastening screw 11 as illustrated earlier in FIG. 4. The 9th hole 25 receives the spring-loaded pin 23 of T-section member 3 when the T-section member 3 is inserted in rear support member 4 as depicted in FIGS. 2, 3 and 5. A portion of the rear support member 4 is bent to form an approximate angle $\beta$ of 105 degrees with the longer portion of the tube. The rear support member 4 is made of a light weight metal tubing such as aluminum.

Referring now to FIGS. 17 and 18, there are shown a plan view of the right front support member 5 and a partial cross-section view of right front support member 5 taken along line 18—18 of FIG. 17. The right-front support member 5 is identical in size, shape, and function to left front support member 5A. It is also similar in size and shape to rear support member 4. A portion of the support members 5 and 5A is bent to form an approximate angle $\beta$ of 105 degrees with the longer portion of the tubing. Two holes, lOth hole 26 and llth hole 27 are located drilled transversely at one end of the tubing of right front support member 5. Both the holes are bored at an angle $\alpha$ of approximately 75 degrees from the axis of the bend formed in the support member, as shown in FIG. 18. For the left front support member 5A, angle $\alpha$ is 105 degrees, which is the mirror image of that for the right front support member 5. This is done so that, when assembled as shown in FIG. 1, the bent portions of both front support members 5 and 5A, will be tilted outwardly as well as upwardly.

Referring lastly to FIGS. 19 and 20, there are shown a plan view of the backrest 2 and a side elevation view. The side elevation view of FIG. 20 is taken along line 20—20 of FIG. 19. The backrest is made of a light weight material such as aluminum; of sufficient thickness to provide rigidity, and sufficient width to provide support for the human body. The front surface of the backrest is made slightly concave, for the sake of comfort when the human back is leaning against it. On the back surface of the backrest 2 are located and fastened, two strips of removable adhesive pads 7 such as "VELCRO". These adhesive pads mate with those located on the sling 1, to hold the backrest 2 in place on the assembled chair.

From the above description, it is apparent that the preferred embodiment achieves the object of the present invention. Alternative embodiments and various modifications of the embodiments depicted will be apparent from the above description to those skilled in the art. These and other alternatives are considered to be equivalent and within the spirit and scope of the present invention.

Having described the invention, what is claimed is:

1. A light weight compact chair device comprising: a sling; a backrest; a rear support member; a T-section member which fits into said rear support member, providing support for said backrest and said sling; a right front support member and a left front support member; means connecting the rear support member to the right front support member and the left front support member to form a rigid stable frame which is capable of supporting the sling and a person sitting thereon; said means including a bracket support mechanism which, when connected to the rear support member and the right front and left front support members, allows the three support members to be either locked in use position as a frame, or folded together in substantial alignment to make a lightweight, compact carrying package; wherein the bracket support mechanism comprises (a) a right bracket support;
(b) a left bracket support;
(c) a center bracket support;
(d) two fastening screws; and
(e) two bracket release assemblies;

said right bracket support, left bracket support and center bracket support being pivotably connected together by said fastening screws, and held rigid by said bracket release assemblies, forming a common plane with the floor or ground;

said bracket support mechanism being designed so that finger pressure applied to said bracket release assemblies, allow the folding back of said right front and left front support members to be in substantial parallel alignment with said rear support member;

said bracket support mechanism being designed so that when assembled into the use position, said rear support member and said right front and left front support members ensure a firm base on the ground;

said center bracket support being approximately hexagonal in shape and having a hole bored axially in it to accomodate said rear support member said center bracket support having two tapped holes located in opposite sides to receive said fastening screws, and two socket holes located on opposite sides to receive the pin heads of said bracket release assemblies;

said right bracket support and left bracket support being rectangular in shape and identical, except for the mirror image location of holes for said bracket release assembly; each said right and left bracket support having a hole bored axially in it to accomodate said right front support member or left front support member, and having two holes passing transversely through the block section to accomodate said fastening screw and said bracket release assembly;

said bracket support mechanism being made of a light weight material such as aluminum or a suitably molded plastic.

2. The bracket release assemblies of claim 1 wherein:

said bracket release assemblies each comprise a pin stepped in diameter to form a head at one end and having a pin retainer hole located in the smaller diameter end of said pin, a metal spring sized to fit closely over said pin smaller diameter, a release tab having a hole in it for fitting over the end of said pin, and a pin retainer; said pin and release tab being made of aluminum, steel or a suitable molded plastic; said pin retainer being made of stiff wire of a diameter sized to fit easily through a hole located in the end of said pin, holding said release tab against said spring which exerts pressure against the stepped diameter shoulder of said pin, providing a spring loaded assembly.

3. The bracket support mechanism of claim 1 wherein:

substantial tabs are provided on either side of said bracket support mechanism, for the purpose of countering any tendency to tip sideways.

4. The release tab of claim 2 wherein:

said release tab is shaped and sized to act as a lever against the surface of said right and left bracket supports when assembled in place, so that applied finger pressure on said release tab will cause withdrawal in said bracket release assembly, of said pin from its socket in said center bracket support.

5. A means for connecting a rear support member to a right front support member and a left front support member, forming a rigid stable frame which is capable of supporting a sling and a person sitting thereon; said means including a bracket support mechanism which, when connected to the rear support member and the right front and left front support members, allows the three support members to be either locked in place as a frame, or folded together in substantial alignment to make a lightweight, compact carrying package.

* * * * *